US012129529B2

(12) United States Patent
Uchida et al.

(10) Patent No.: US 12,129,529 B2
(45) Date of Patent: Oct. 29, 2024

(54) OXIDATION-RESISTANT METALLIC TIN

(71) Applicant: JX Nippon Mining & Metals Corporation, Tokyo (JP)

(72) Inventors: Takahiro Uchida, Ibaraki (JP); Toru Imori, Tokyo (JP); Koichi Takemoto, Ibaraki (JP); Shiro Tsukamoto, Ibaraki (JP)

(73) Assignee: JX Advanced Metals Corporation, Tokyo (JP)

( * ) Notice: Subject to any disclaimer, the term of this patent is extended or adjusted under 35 U.S.C. 154(b) by 94 days.

(21) Appl. No.: 17/287,205

(22) PCT Filed: Feb. 27, 2020

(86) PCT No.: PCT/JP2020/008020

§ 371 (c)(1),
(2) Date: Apr. 21, 2021

(87) PCT Pub. No.: WO2020/179614

PCT Pub. Date: Sep. 10, 2020

(65) Prior Publication Data

US 2021/0381082 A1 Dec. 9, 2021

(30) Foreign Application Priority Data

Mar. 4, 2019 (JP) ..... 2019-039018

(51) Int. Cl.
*C22C 13/00* (2006.01)
*B65D 81/20* (2006.01)

(52) U.S. Cl.
CPC ..... *C22C 13/00* (2013.01); *B65D 81/2007* (2013.01)

(58) Field of Classification Search
CPC ..... C22C 13/00
See application file for complete search history.

(56) References Cited

U.S. PATENT DOCUMENTS

| | | | |
|---|---|---|---|
| 2009/0098012 | A1 | 4/2009 | Shindo et al. |
| 2016/0097139 | A1 | 4/2016 | Takemoto et al. |
| 2018/0298506 | A1 | 10/2018 | Imori et al. |
| 2019/0055077 | A1 | 2/2019 | Imori et al. |
| 2019/0153607 | A1 | 5/2019 | Imori et al. |

FOREIGN PATENT DOCUMENTS

| | | | |
|---|---|---|---|
| EP | 3421389 | A1 | 2/2017 |
| EP | 3187299 | A1 | 7/2017 |
| JP | 2008156668 | A | 7/2008 |
| JP | 4934785 | B2 | 5/2012 |
| JP | 2013189710 | A | 9/2013 |
| JP | 201674969 | A | 5/2016 |
| JP | 2018111135 | A | 7/2018 |
| KR | 10-20180095641 | A | 2/2017 |
| KR | 10-20170010012 | A | 7/2017 |
| TW | 201718883 | A | 6/2017 |
| TW | 201736604 | A | 10/2017 |
| WO | 2017145947 | A1 | 8/2017 |

OTHER PUBLICATIONS

Taiwan Office Action of the corresponding Taiwan Patent Application No. 109106911 dated Dec. 9, 2020, 4 pages (with machine translation).

Ashkhotov et al., "On the Mechanism of Electron-Stimulated Formation of a Nanosize C—Sn Coating on a Tin Surface", The Physics of Metals and Metallography, vol. 10, No. 6, dated Dec. 2010, pp. 553-556.

Japanese International Search Report for PCT/JP2020/008020 dated Mar. 7, 2020, 4 pages.

European Extended Search Report for corresponding EP Application No. 20767131.4 dated Dec. 1, 2021, 9 pages.

Salt F.W. et al.: "Determination of the Oxide Film Thickness on Tin", Nature vol. 178, dated Aug. 25, 1956, pp. 434-435, retrieved from the Internet: URL:https://www.nature.com/articles/178434b0_pdf; retrieved on Nov. 22, 2021.

Korean Office Action dated Oct. 22, 2021 for corresponding KR Application No. 10-2020-7021936, 8 pages.

Korean Office Action for corresponding Korean Patent Application No. 10-2020-7021936 dated Jul. 23, 2022, 9 pages with translation.

Korean Office Action for corresponding Korean Patent Application No. 10-2020-7021936 dated Sep. 5, 2023, 9 bages.

Korean Office Action in corresponding Korean Patent Application No. 10-2020-7021936 dated Mar. 17, 2023, 8 pages with Translation.

*Primary Examiner* — Jophy S. Koshy
(74) *Attorney, Agent, or Firm* — Faegre Drinker Biddle & Reath LLP

(57) ABSTRACT

In the present invention, a high-purity metallic tin suitable for use in an EUV exposure device is provided through use of an oxidation-resistant metallic tin, the oxidation-resistant metallic tin containing 99.995 mass % or more of tin, and unavoidable impurities, and the thickness of an oxide film being 2.0 nm or less when the surface of a cut face of the oxidation-resistant metallic tin is measured by AES.

8 Claims, 2 Drawing Sheets

OXIDATION-RESISTANT METALLIC TIN

TECHNICAL FIELD

The present invention relates to oxidation-resistant metallic tin.

BACKGROUND ART

As semiconductor manufacturing continues to become more refined, the demand for high-purity characteristics of high-purity metallic tin is also increasing. High-purity metallic tin is manufactured by, for example, electrolytic refining, and is packed and shipped so as to not impair the high-purity characteristics. Patent Document 1 discloses manufacturing high-purity metallic tin by electrolytic refining. Patent Document 2 discloses a method for packaging high-purity metallic tin.

CITATION LIST

Patent Literature

Patent Document 1: Japanese Unexamined Patent Application, Publication No. 2016-74969

Patent Document 2: PCT International Publication No. WO 2017/145947 A1

SUMMARY OF INVENTION

Technical Problem

In order to refine the manufacture of a semiconductor, molten tin is used in an EUV exposure device (extreme ultraviolet lithography device). Thus, there is a need for high-purity metallic tin suitable for such use.

It is therefore an object of the present invention to provide a high-purity metallic tin which can be suitably used in an EUV exposure device.

Solution to Problem

Tin that is used in an EUV exposure device is used in a molten state. Molten tin droplets of no more than 20 μm that have been discharged from a container called a droplet generator are reacted with a $CO_2$ gas laser to generate EUV (extreme ultraviolet radiation). In order to generate stable EUV, the tin droplets of no more than 20 μm must be stably and continuously discharged.

However, the present inventors discovered that if oxides are present in large amounts in the tin, the distal end of the droplet generator may become clogged, and this can obstruct the stable generation of droplets. Further, even if the amount of oxides included in the tin is miniscule, in the EUV exposure device, the molten tin is supplied continuously, and thus the oxides which are the cause of clogging may accumulate if the EUV exposure device is operated continuously, and this can eventually lead to trouble. In order to prevent such trouble, the operation of the EUV exposure device must be periodically stopped in order to clean the device or exchange its parts, and this results in a considerable reduction in operation efficiency of the overall line including the EUV exposure device.

Thus, the present inventors undertook intensive research and development geared toward an oxidation-resistant high-purity metallic tin with a reduced oxide content so as to enable the suitable use of such tin in an EUV exposure device.

Therein, the present inventors embarked on further research and development with a focus on the fact that metallic tin before melting is handled as a solid, and thus oxidation of the metallic tin proceeds on the surface of the metal solid. As a result, the present inventors obtained a high-purity metallic tin in which the progression of surface oxidation is remarkably reduced by the means described below, thereby arriving at the present invention.

Given the above, the present invention includes the following:

(1) An oxidation-resistant metallic tin comprising at least 99.995% by weight of tin, and inevitable impurities, wherein the thickness of an oxide film as measured by AES on a surface of a cutting face is 2.0 nm or less.

Effects of Invention

In the oxidation-resistant high-purity metallic tin according to the present invention, the progression of surface oxidation is remarkably reduced, and thus the metallic tin can be suitably used as a molten tin for use in an EUV exposure device.

DESCRIPTION OF EMBODIMENTS

Figure 1:
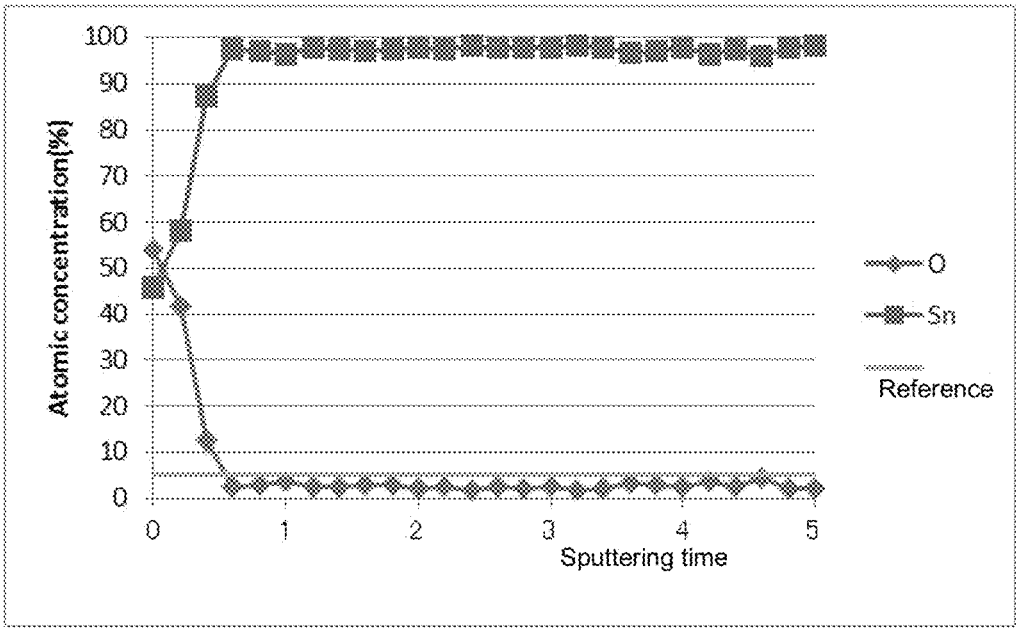
FIG. 1 is a graph showing the results of AES measurement of Sample 3 after atmospheric exposure for 72 hours.

Concrete embodiments of the present invention will be described below in detail, but the present invention is not limited to the concrete embodiments described below.

[Oxidation-Resistant Metallic Tin]

In a preferred embodiment, the oxidation-resistant metallic tin according to the present invention comprises at least 99.995% by weight of tin, and inevitable impurities, and the thickness of an oxide film as measured by AES on a surface of a cutting face is 2.0 nm or less.

[Thickness of Oxide Film]

In a preferred embodiment, in the oxidation-resistant metallic tin according to the present invention, the thickness of an oxide film on the surface of the cutting face as measured by AES upon starting the measurement after atmospheric exposure for 72 hours immediately after cutting is, for example, 2.0 nm or less, preferably 1.9 nm or less, more preferably 1.8 nm or less, more preferably 1.7 nm or less, more preferably 1.6 nm or less, more preferably 1.5 nm or less, more preferably 1.4 nm or less, more preferably 1.3 nm or less, and more preferably 1.2 nm or less. "Oxidation-resistant" as used in the present invention means that the thickness of the oxide film after atmospheric exposure for 72 hours immediately after cutting is reduced as described above. The degree of oxidation resistance is quantified by measuring the thickness of the oxide film under predetermined conditions. The atmospheric exposure for 72 hours is conducted at room temperature, specifically at a temperature maintained at about 25° C.

The thickness of the oxide film can be measured by AES (auger electron spectroscopy) (device used: PHI-700 from ULVAC-PHI, voltage 10 kV, current 10 nA). Specifically, the thickness of the oxide film can be measured by the means described below in the examples. In AES, the vertical axis is converted to atomic concentration (%), and the time required until the first measurement point at which the measured value of oxygen reaches 5% (atomic %) or less is calculated. The oxide film is then calculated from this time and a sputtering rate. For example, if the required time is 1 minute and the sputtering rate is 2 nm/min, the oxide film can be calculated as 1 min×2 nm/min=2 nm.

[Inevitable Impurities]

In the oxidation-resistant metallic tin of the present invention, the content of inevitable impurities can be, for example, 100 ppm by weight, preferably 10 ppm by weight. In other words, in the oxidation-resistant metallic tin of the present invention, the content of Sn can be, for example, 99.995% by weight, preferably 99.999% by weight.

The calculation of the content of inevitable impurities and the tin purity can be performed using the results of GDMS. Elements for which the measurement result was less than a measurement limit are calculated as being included at the measurement limit value. For example, if the GDMS analysis result of the Li content was less than 0.005 ppm, the Li content is treated as 0.005 ppm when calculating the tin purity.

The total value of the impurity elements of Sample 2 in Table 1-1 calculated based on the above definition is 7.672 ppm by weight, and thus the purity of Sample 2 is 99.999% by weight or more, i.e. a purity of 5N. Meanwhile, the total value of the impurity elements of Sample 1 is 13.866 ppm by weight, and thus the purity of Sample 1 is 99.99% by weight or more, i.e. a purity of 4N.

In a preferred embodiment, the content of the following elements which are inevitable impurities can be in the ranges given below. The unit of the numerical values of the content shown below is as follows: when wt % is written, the unit is % by weight; when ppm is written, the unit is ppm by weight; and when nothing is written, the unit is ppm by weight.

Li content: 0.1 ppm or less, preferably less than 0.005 ppm (less than measurement limit)

Be content: 0.1 ppm or less, preferably less than 0.005 ppm (less than measurement limit)

B content: 0.1 ppm or less, preferably less than 0.005 ppm (less than measurement limit)

F content: 0.5 ppm or less, preferably less than 0.05 ppm (less than measurement limit)

Na content: 0.1 ppm or less, preferably less than 0.01 ppm (less than measurement limit)

Mg content: 0.1 ppm or less, preferably less than 0.01 ppm (less than measurement limit)

Al content: 0.1 ppm or less, preferably less than 0.01 ppm (less than measurement limit)

Si content: 0.1 ppm or less, preferably less than 0.01 ppm (less than measurement limit)

P content: 0.1 ppm or less, preferably less than 0.01 ppm (less than measurement limit)

S content: 0.05 ppm or less, preferably less than 0.01 ppm (less than measurement limit)

Cl content: 0.1 ppm or less, preferably less than 0.01 ppm (less than measurement limit)

K content: 0.1 ppm or less, preferably less than 0.01 ppm (less than measurement limit)

Ca content: 0.1 ppm or less, preferably less than 0.01 ppm (less than measurement limit)

Sc content: 0.1 ppm or less, preferably less than 0.001 ppm (less than measurement limit)

Ti content: 0.1 ppm or less, preferably less than 0.005 ppm (less than measurement limit)

V content: 0.1 ppm or less, preferably less than 0.001 ppm (less than measurement limit)

Cr content: 0.1 ppm or less, preferably less than 0.005 ppm (less than measurement limit)

Mn content: 0.05 ppm or less, preferably less than 0.005 ppm (less than measurement limit)

Fe content: 0.05 ppm or less, preferably less than 0.005 ppm (less than measurement limit)

Co content: 0.1 ppm or less, preferably less than 0.01 ppm (less than measurement limit)

Ni content: 0.1 ppm or less, preferably less than 0.01 ppm (less than measurement limit)

Cu content: 0.1 ppm or less, preferably less than 0.005 ppm (less than measurement limit)

Zn content: 0.1 ppm or less, preferably less than 0.01 ppm (less than measurement limit)

Ga content: 0.1 ppm or less, preferably less than 0.005 ppm (less than measurement limit)

Ge content: 0.1 ppm or less, preferably less than 0.01 ppm (less than measurement limit)

As content: 0.1 ppm or less, preferably less than 0.005 ppm (less than measurement limit)

Se content: 0.1 ppm or less, preferably less than 0.01 ppm (less than measurement limit)

Br content: 0.5 ppm or less, preferably less than 0.05 ppm (less than measurement limit)

Rb content: 0.1 ppm or less, preferably less than 0.005 ppm (less than measurement limit)

Sr content: 0.1 ppm or less, preferably less than 0.005 ppm (less than measurement limit)

Y content: 0.1 ppm or less, preferably less than 0.005 ppm (less than measurement limit)

Zr content: 0.1 ppm or less, preferably less than 0.005 ppm (less than measurement limit)

Nb content: 0.1 ppm or less, preferably less than 0.005 ppm (less than measurement limit)

Mo content: 0.1 ppm or less, preferably less than 0.01 ppm (less than measurement limit)

Ru content: 0.1 ppm or less, preferably less than 0.01 ppm (less than measurement limit)

Rh content: 0.1 ppm or less, preferably less than 0.005 ppm (less than measurement limit)

Pd content: 0.1 ppm or less, preferably less than 0.005 ppm (less than measurement limit)

Ag content: 0.1 ppm or less, preferably less than 0.005 ppm (less than measurement limit)

Cd content: 0.5 ppm or less, preferably less than 0.05 ppm (less than measurement limit)

In content: 5 ppm or less, preferably less than 1 ppm (less than measurement limit)

Sb content: 1 ppm or less, preferably less than 0.5 ppm (less than measurement limit)

Te content: 1 ppm or less, preferably less than 0.1 ppm (less than measurement limit)

I content: 0.5 ppm or less, preferably less than 0.05 ppm (less than measurement limit)

Cs content: 0.5 ppm or less, preferably less than 0.05 ppm (less than measurement limit)

Ba content: 1 ppm or less, preferably less than 0.1 ppm (less than measurement limit)

La content: 1 ppm or less, preferably less than 0.1 ppm (less than measurement limit)

Ce content: 0.1 ppm or less, preferably less than 0.005 ppm (less than measurement limit)

Pr content: 1 ppm or less, preferably less than 0.1 ppm (less than measurement limit)

Nd content: 0.1 ppm or less, preferably less than 0.005 ppm (less than measurement limit)

Sm content: 0.1 ppm or less, preferably less than 0.005 ppm (less than measurement limit)

Eu content: 0.1 ppm or less, preferably less than 0.01 ppm (less than measurement limit)

Gd content: 0.1 ppm or less, preferably less than 0.005 ppm (less than measurement limit)

Tb content: 0.1 ppm or less, preferably less than 0.005 ppm (less than measurement limit)

Dy content: 0.1 ppm or less, preferably less than 0.005 ppm (less than measurement limit)

Ho content: 0.1 ppm or less, preferably less than 0.005 ppm (less than measurement limit)

Er content: 0.1 ppm or less, preferably less than 0.005 ppm (less than measurement limit)

Tm content: 0.1 ppm or less, preferably less than 0.005 ppm (less than measurement limit)

Yb content: 0.1 ppm or less, preferably less than 0.005 ppm (less than measurement limit)

Lu content: 0.1 ppm or less, preferably less than 0.005 ppm (less than measurement limit)

Hf content: 0.1 ppm or less, preferably less than 0.01 ppm (less than measurement limit)

Ta content: 10 ppm or less, preferably less than 5 ppm (less than measurement limit)

W content: 0.1 ppm or less, preferably less than 0.01 ppm (less than measurement limit)

Re content: 0.1 ppm or less, preferably less than 0.01 ppm (less than measurement limit)

Os content: 0.1 ppm or less, preferably less than 0.01 ppm (less than measurement limit)

Ir content: 0.1 ppm or less, preferably less than 0.01 ppm (less than measurement limit)

Pt content: 0.1 ppm or less, preferably less than 0.01 ppm (less than measurement limit)

Au content: 0.5 ppm or less, preferably less than 0.05 ppm (less than measurement limit)

Hg content: 0.5 ppm or less, preferably less than 0.05 ppm (less than measurement limit)

Tl content: 0.2 ppm or less, preferably less than 0.02 ppm (less than measurement limit)

Pb content: 0.1 ppm or less, preferably less than 0.01 ppm (less than measurement limit)

Bi content: 0.1 ppm or less, preferably less than 0.005 ppm (less than measurement limit)

Th content: 0.1 ppm or less, preferably less than 0.005 ppm (less than measurement limit)

U content: 0.1 ppm or less, preferably less than 0.005 ppm (less than measurement limit)

PREFERRED EMBODIMENTS OF THE PRESENT INVENTION

As a preferred embodiment, the present invention includes the following (1):

(1) An oxidation-resistant metallic tin comprising at least 99.995% by weight of tin, and inevitable impurities, wherein the thickness of an oxide film as measured by AES on a surface of a cutting face is 2.0 nm or less.

(2) The oxidation-resistant metallic tin according to (1), wherein the thickness of the oxide film on the surface of the cutting face as measured by AES upon starting the measurement after atmospheric exposure for 72 hours immediately after cutting is 2.0 nm or less.

(3) The oxidation-resistant metallic tin according to (1) or (2), wherein the thickness of the oxide film as measured by AES is 1.2 nm or less.

(4) The oxidation-resistant metallic tin according to any one of (1) to (3), wherein the oxidation-resistant metallic tin comprises 99.999% by weight of tin, and inevitable impurities.

(5) The oxidation-resistant metallic tin according to any one of (1) to (4), wherein as the inevitable impurities, the content of Mn is less than 0.005 ppm, the content of Fe is less than 0.005 ppm, the content of Sb is less than 0.5 ppm, and the content of S is less than 0.01 ppm.

(6) An oxidation-resistant metallic tin packaging body obtained by vacuum-packing the oxidation-resistant metallic tin according to any one of (1) to (5).

EXAMPLES

In the following, the present invention will be explained in further detail by way of examples, but the present invention is not limited to the examples explained below.

Example 1

[Preparation of Oxidation-Resistant High-Purity Metallic Tin]

[Electrolytic Refining]

An ingot of commercially available tin (purity of 4N) was prepared. A portion of this ingot was collected as Sample 1 for the purpose of analysis.

The commercially available tin (purity of 4N) was subjected to electrolytic refining to obtain purified tin. Specifically, the electrolytic refining was carried out according to the following procedures and conditions:

In an electrolytic bath in which a cathode and an anode are partitioned by a negative ion exchange membrane (Asahi Glass Co., Ltd., Selemion AMV), a predetermined amount of a sulfuric acid solution was input to the cathode side, and a dilute sulfuric acid solution of pH 0.5 was input to the anode side. An anode cast from raw material tin and a cathode made of titanium were placed in the electrolytic bath and electrolytically leached under a current density of 2 A/dm$^2$ at a solution temperature of 33° C. to produce a tin sulfate electrolytic solution (tin concentration of 105 g/L).

During the electrowinning, 5 g/L of hydroquinone was added as an antioxidant to the anode side.

The anode chamber electrolytic solution was removed and supplied to a solution washing tank in which lead is removed. To the solution washing tank, slurried strontium carbonate dispersed in pure water was added in an amount of 5 g/L relative to the electrolytic solution and then stirred for 16 hours. The resulting electrolytic solution after stirring was subjected to solid-liquid separation by suction filtration and thereby lead in the electrolytic solution was removed, and then the electrolytic solution from which lead was removed was charged to the cathode side. The concentration of lead after lead removal was less than 0.1 mg/L.

To the electrolytic solution on the cathode side, 5 g/L of polyoxyethylene (10) nonyl phenyl ether was added. In this state, electrowinning was performed at a current density of 2 A/dm$^2$, pH 0.5, and a solution temperature of 30° C., until the concentration of tin in the cathode-side electrolytic solution became 48 g/L, and then the cathode was pulled out of the electrolytic bath. Electrodeposited tin that had deposited on the cathode was peeled off, and thereby tin purified by electrolytic refining was obtained.

The purified tin obtained by electrolytic refining was placed in a carbon casting mold and melted at about 300° C. to obtain an approximately 30 kg ingot (shape: columnar; size: ϕ150 mm×250 mm) of high-purity metallic tin.

[Heat Treatment]

The ingot of high-purity metallic tin obtained by electrolytic refining as described above was subjected to a heat treatment at high temperature under a high vacuum (800° C., $10^{-3}$ Pa, 12 hours), and then the ingot was collected.

[GDMS Analysis]

A portion of the heat-treated ingot was collected as Sample 2. Sample 2 was then subjected to GDMS analysis (device name: Astrum). The results thereof are shown below in Table 1 (Table 1-1, Table 1-2, and Table 1-3). In Table 1, the unit for all numerical values for which no unit is indicated is ppm by weight. If the numerical value is marked with an inequality sign, this indicates that the numerical value was less than the measurement limit. For example, "<0.005" for Cu indicates that the content of Cu was less than the measurement limit (0.005 ppm by weight). C, N, and O, which are gas components, were not measured. As shown in Table 1, it was confirmed that the heat-treated ingot had an extremely high degree of purity (purity: 5N).

[Forging]

The ingot (shape: columnar; size: ϕ150 mm×250 mm) was forged to a ϕ45 mm columnar shape. The forged ϕ45 mm columnar ingot was cut to a length of approximately 100 mm, and then the outer circumferential surface was shaved by lathe machining to obtain a ϕ30 mm columnar ingot (length: 100 mm). When performing the lathe machining, ethanol, which evaporates easily, was used as the cutting oil so that oil would not remain on the surface.

[Oxide Film Measurement by AES (Auger Electron Spectroscopy)]

The ϕ30 mm columnar ingot obtained as described above was cut with a lathe into a disc shape with a 3 mm thickness so as to have a size that can be measured by AES, and then immediately washed with ethanol to obtain Sample 3. Sample 3 was measured by AES (device name: PHI-700 from ULVAC-PHI; conditions: voltage 10 kV, current 10 nA) after atmospheric exposure for 72 hours. The time from cutting to the start of measurement was set to about 72 hours. The AES measurement was conducted at a sputtering rate of 2 nm/min by $SiO_2$ conversion, and the time of the first measurement point at which the oxygen element ratio reached 5% or less was calculated as a sputtering time corresponding to the thickness of the oxide film. The thickness of the oxide film was then calculated using the sputtering time and the sputtering rate (2 nm/min).

Figure 2:
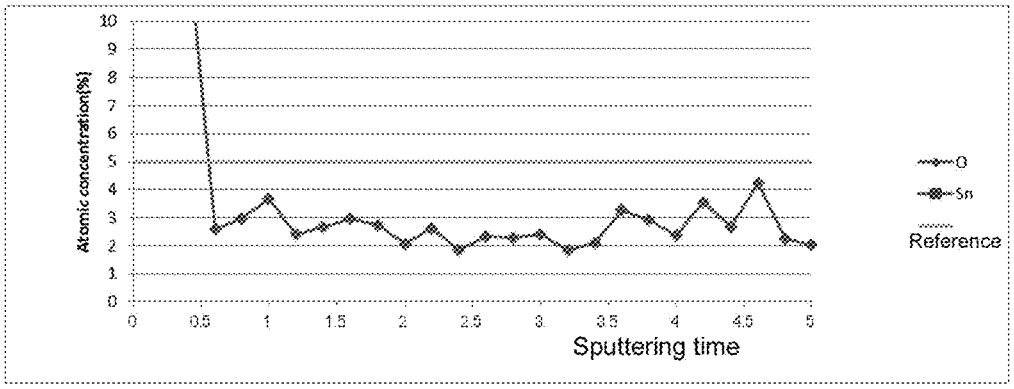
FIG. 2 is a partially enlarged view of FIG. 1.

FIG. 1 is a graph showing the results of AES measurement of Sample 3 after atmospheric exposure for 72 hours. The horizontal axis in the graph of FIG. 1 is the sputtering time (min), and the vertical axis is the Atomic concentration (%). FIG. 2 is a partially enlarged view of FIG. 1. In FIG. 2, the sputtering time at the first measurement point at which the oxygen atomic concentration dropped below 5% was 0.6 min. In other words, the thickness of the oxide film on the cutting face of Sample 3 after atmospheric exposure for 72 hours was 1.2 nm.

TABLE 1-1

| | Sample 2 | Sample 1 |
|---|---|---|
| Li | <0.005 | <0.005 |
| Be | <0.005 | <0.005 |
| B | <0.005 | <0.005 |

TABLE 1-1-continued

| | Sample 2 | Sample 1 |
|---|---|---|
| C | — | — |
| N | — | — |
| O | — | — |
| F | <0.05 | <0.05 |
| Na | <0.01 | <0.01 |
| Mg | <0.01 | <0.01 |
| Al | <0.01 | <0.01 |
| Si | <0.01 | <0.01 |
| P | <0.01 | <0.01 |
| S | <0.01 | 3.2 |
| Cl | <0.01 | <0.01 |
| K | <0.01 | <0.01 |
| Ca | <0.01 | <0.01 |
| Sc | <0.001 | <0.001 |
| Ti | <0.005 | <0.005 |
| V | <0.001 | <0.001 |
| Cr | <0.005 | <0.005 |
| Mn | <0.005 | <0.005 |
| Fe | <0.005 | 0.11 |
| Co | <0.01 | <0.01 |
| Ni | <0.01 | <0.01 |
| Cu | <0.005 | 0.037 |
| Zn | <0.01 | <0.01 |
| Ga | <0.005 | <0.005 |

TABLE 1-2

| | Sample 2 | Sample 1 |
|---|---|---|
| Ge | <0.01 | <0.01 |
| As | <0.005 | <0.005 |
| Se | <0.01 | <0.01 |
| Br | <0.05 | <0.05 |
| Rb | <0.005 | <0.005 |
| Sr | <0.005 | <0.005 |
| Y | <0.005 | <0.005 |
| Zr | <0.005 | <0.005 |
| Nb | <0.005 | <0.005 |
| Mo | <0.01 | <0.01 |
| Ru | <0.01 | <0.01 |
| Rh | <0.005 | <0.005 |
| Pd | <0.005 | <0.005 |
| Ag | <0.005 | 0.082 |
| Cd | <0.05 | <0.05 |
| In | <1 | <1 |
| Sn | — | — |
| Sb | <0.5 | 1.3 |
| Te | <0.1 | <0.1 |
| I | <0.05 | <0.05 |
| Cs | <0.05 | <0.05 |
| Ba | <0.1 | <0.1 |
| La | <0.1 | <0.1 |
| Ce | <0.005 | <0.005 |
| Pr | <0.1 | <0.1 |
| Nd | <0.005 | <0.005 |
| Sm | <0.005 | <0.005 |

TABLE 1-3

| | Sample 2 | Sample 1 |
|---|---|---|
| Eu | <0.01 | <0.01 |
| Gd | <0.005 | <0.005 |
| Tb | <0.005 | <0.005 |
| Dy | <0.005 | <0.005 |
| Ho | <0.005 | <0.005 |
| Er | <0.005 | <0.005 |
| Tm | <0.005 | <0.005 |
| Yb | <0.005 | <0.005 |
| Lu | <0.005 | <0.005 |
| Hf | <0.01 | <0.01 |
| Ta | <5 | <5 |
| W | <0.01 | <0.01 |

TABLE 1-3-continued

| | Sample 2 | Sample 1 |
|---|---|---|
| Re | <0.01 | <0.01 |
| Os | <0.01 | <0.01 |
| Ir | <0.01 | <0.01 |
| Pt | <0.01 | <0.01 |
| Au | <0.05 | <0.05 |
| Hg | <0.05 | <0.05 |
| Tl | <0.02 | <0.02 |
| Pb | <0.01 | 2.0 |
| Bi | <0.005 | <0.005 |
| Th | <0.005 | <0.005 |
| U | <0.005 | <0.005 |

Comparative Example 1

Similar to that used in Example 1, a 15 kg ingot of commercially available tin (purity of 4N) was prepared. In order to provide a size that can be measured by AES, this tin was cut with a band saw and scissors to prepare a sample with a shape of 10 mm×10 mm×3 mm Thereafter, in order to remove any stains which adhered due to the cutting oil or the like, the tin was immediately washed with ethanol so as to obtain Sample 4. Just as in Example 1, Sample 4 was subjected to AES measurement after atmospheric exposure for 72 hours and then the thickness of the oxide film was calculated.

Figure 3:
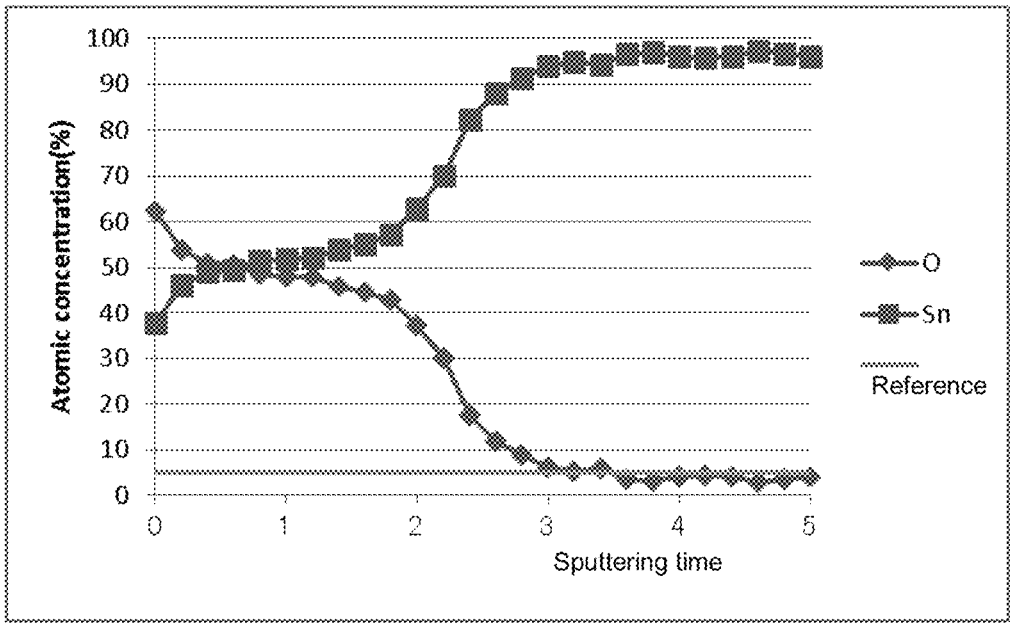
FIG. 3 is a graph showing the results of AES measurement of Sample 4 after atmospheric exposure for 72 hours.
Figure 4:
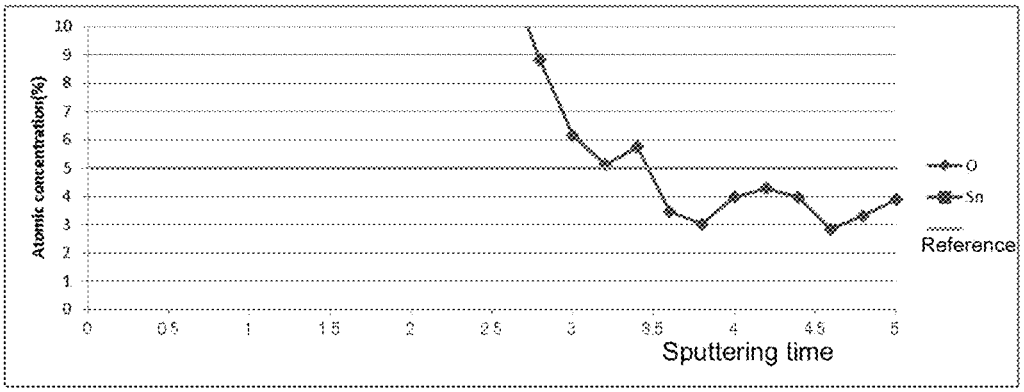
FIG. 4 is a partially enlarged view of FIG. 3.

FIG. 3 is a graph showing the results of AES measurement of Sample 4 after atmospheric exposure for 72 hours. FIG. 4 is a partially enlarged view of FIG. 3. In FIG. 4, the sputtering time at the first measurement point at which the oxygen atomic concentration dropped below 5% was 3.6 min. In other words, the thickness of the oxide film on the cutting face of Sample 4 after atmospheric exposure for 72 hours was 7.2 nm.

Comparative Example 2

Similar to that used in Example 1, an ingot of commercially available tin (purity of 4N) was prepared and subjected to electrolytic refining to obtain a high-purity metallic tin ingot. However, unlike in Example 1, the ingot was not subjected to subsequent heat treatment and forging. The obtained high-purity metallic tin ingot was cut in a similar fashion to Comparative Example 1 to obtain a sample with a shape of 10 mm×10 mm×3 mm Thereafter, in order to remove any stains which adhered due to the cutting oil or the like, the tin was immediately washed with ethanol so as to obtain Sample 5. Just as in Example 1, Sample 5 was subjected to AES measurement after atmospheric exposure for 72 hours and then the thickness of the oxide film was calculated. The oxide film thickness was 2.4 nm.

Comparative Example 3

Similar to that used in Example 1, commercially available tin (purity of 4N) was prepared. However, unlike in Example 1, the tin was not subjected to electrolytic refining. As in Example 1, the commercially available tin (purity of 4N) was subjected to a heat treatment (800° C., $10^{-3}$ Pa, 12 hours) and then forged, and subsequently a ϕ30 mm columnar ingot was produced by cutting and lathing. This ingot was further cut with a lathe into a disc shape with a thickness of 3 mm, and then immediately washed with ethanol to obtain Sample 6. Just as in Example 1, Sample 6 was subjected to AES measurement after atmospheric exposure for 72 hours and then the thickness of the oxide film was calculated. The oxide film thickness was 3.6 nm.

TABLE 2

| | Electrolytic Refining | Heat Treat-ment | Forging | Storage Conditions | Oxide Film Thickness |
|---|---|---|---|---|---|
| Ex. 1 (Sample 3) | Yes | Yes | Yes | 72 hours in atmosphere | 1.2 nm |
| Comp. Ex. 1 (Sample 4) | No | No | No | 72 hours in atmosphere | 7.2 nm |
| Comp. Ex. 2 (Sample 5) | Yes | No | No | 72 hours in atmosphere | 2.4 nm |
| Comp. Ex. 3 (Sample 6) | No | Yes | Yes | 72 hours in atmosphere | 3.6 nm |

INDUSTRIAL APPLICABILITY

According to the present invention, a high-purity metallic tin which can be suitably used in an EUV exposure device can be provided. Thus, the present invention is industrially useful.

The invention claimed is:

1. An oxidation-resistant metallic tin made by steps of an electrolytic refining process, heat treatment and then forging, wherein:

the oxidation-resistant metallic tin comprises at least 99.995% by weight of tin, and inevitable impurities, the oxidation-resistant metallic tin has an oxide film on a surface of a cutting face of the oxidation-resistant metallic tin, and after the forging, a thickness of the oxide film on the surface of the cutting face as measured by AES, upon starting the measurement after atmospheric exposure for 72 hours immediately after cutting, is 2.0 nm or less but greater than zero nm.

2. The oxidation-resistant metallic tin according to claim 1, wherein the thickness of the oxide film as measured by AES is 1.2 nm or less but greater than zero nm.

3. The oxidation-resistant metallic tin according to claim 1, wherein the oxidation-resistant metallic tin comprises 99.999% by weight of tin, and inevitable impurities.

4. The oxidation-resistant metallic tin according to claim 1, wherein as the inevitable impurities, the content of Mn is less than 0.005 ppm by weight, the content of Fe is less than 0.005 ppm by weight, the content of Sb is less than 0.5 ppm by weight, and the content of S is less than 0.01 ppm by weight.

5. An oxidation-resistant metallic tin packaging body obtained by vacuum-packing the oxidation-resistant metallic tin according to claim 1.

6. An oxidation-resistant metallic tin packaging body obtained by vacuum-packing the oxidation-resistant metallic tin according to claim 2.

7. An oxidation-resistant metallic tin packaging body obtained by vacuum-packing the oxidation-resistant metallic tin according to claim 3.

8. An oxidation-resistant metallic tin packaging body obtained by vacuum-packing the oxidation-resistant metallic tin according to claim 4.

* * * * *